US005609380A

United States Patent [19]

White

[11] Patent Number: 5,609,380

[45] Date of Patent: Mar. 11, 1997

[54] CLAMP ASSEMBLIES FOR DRIVING PILES INTO THE EARTH

[75] Inventor: John L. White, Kent, Wash.

[73] Assignee: American Piledriving Equipment, Inc., Kent, Wash.

[21] Appl. No.: 340,052

[22] Filed: Nov. 15, 1994

[51] Int. Cl.[6] ..... B66C 1/44; E02D 7/18

[52] U.S. Cl. ..... 294/104; 294/88; 405/232

[58] Field of Search ..... 294/86.23, 86.29, 294/86.4, 88, 103.1, 104, 106, 113; 173/49, 90, 91, 124, 128, 130–132, 162.1, 210; 405/228, 232, 245–247, 231

[56] References Cited

U.S. PATENT DOCUMENTS

| | | | |
|---|---|---|---|
| 3,149,851 | 9/1964 | Adams | 294/88 X |
| 3,243,190 | 3/1966 | Peregrine | 294/104 X |
| 3,828,864 | 8/1974 | Haverkamp et al. | 173/49 |
| 3,998,063 | 12/1976 | Harders | 405/231 |
| 4,018,290 | 4/1977 | Schmidt | 173/49 |
| 4,099,387 | 7/1978 | Frederick et al. | 405/274 |
| 4,180,047 | 12/1979 | Bertelson | 405/232 X |
| 4,195,698 | 4/1980 | Nakagawasai | 405/232 X |
| 4,248,550 | 2/1981 | Blaschke et al. | 294/113 X |
| 5,117,925 | 6/1992 | White | 173/162.1 |
| 5,263,544 | 11/1993 | White | 173/162.1 |

FOREIGN PATENT DOCUMENTS 362158A 9/1988 European Pat. Off. .

*Primary Examiner*—Johnny D. Cherry
*Attorney, Agent, or Firm*—Hughes, Multer & Schacht, P.S.

[57] ABSTRACT

A clamp assembly for attaching a pile to a device for inserting and/or extracting the pile. The clamp assembly has a fixed gripping assembly and a movable gripping assembly. The fixed gripping assembly is rigidly attached to a housing. The movable gripping assembly is rotatably attached to a pivot arm that is pivotably attached to the housing. The pile is placed between the gripping assemblies and a piston causes the pivot arm to rotate such that the pile is gripped between the gripping assemblies. The movable gripping assembly rotates relative to the pivot arm into a desirable position relative to the pile as it engages the pile to increase the ability of the clamp assembly to grip the pile. An anvil formed on the top of the clamp assembly facilitates attachment of the clamp assembly to the pile driving and/or extracting device and alleviates damage to the bolts used to attach the clamp assembly to the pile driving and/or extracting device.

20 Claims, 4 Drawing Sheets

CLAMP ASSEMBLIES FOR DRIVING PILES INTO THE EARTH

TECHNICAL FIELD

The present invention relates to clamps that allow vibratory devices to be attached to elongate members and, more particularly, such clamps that are adapted to grip irregularly shaped piles made of wood and/or concrete.

BACKGROUND OF THE INVENTION

In the construction industry, it is often necessary to insert piles into and withdraw piles from the earth. A common scenario is the removal of wooden piles and the replacement of these wooden piles with concrete piles.

To insert piles into and remove piles from the earth, a large driving or pulling force must be applied to the pile. Often, vibratory devices are employed to introduce a vibratory force along the axis of the pile during the process of driving or pulling the pile. The combination of a static pulling or driving force with a vibratory or dynamic force is usually sufficient to overcome the earth's resistance and allow the pile to be inserted or withdrawn.

In cases where the pile is being withdrawn from the earth and/or a vibratory force is being applied, a clamping assembly must be provided to allow a pulling force and/or vibratory forces to be effectively transmitted to the pile. Such clamping devices have heretofore comprised a housing that is attached to a vibratory hammer which in turn is suspended from a crane line and/or vibratory device, a first gripping surface securely attached to the housing, a second gripping surface rigidly connected to a pivot arm that is rotatably attached to the housing, and a piston actuator that acts on the pivot arm to force the second gripping surface against the first gripping surface.

Accordingly, to connect a pile to a vibratory device or tensioning cable, the piston actuator is retracted to create a gap between the first and second gripping surfaces. The pile is then inserted between the first and second gripping surfaces and the piston actuator extended such that the pile is gripped between the first and second gripping surfaces. The pile is thus fixed relative to the housing, and the housing itself can be attached to the vibratory device or tensioning cable.

Users have experienced a variety of problems with such prior art clamping assemblies. For example, because piles, especially wooden piles, are often of irregular shapes and sizes, the gripping surfaces do not engage certain of these piles in a manner that effectively transmits tensioning or vibratory loads thereto. This allows the pile to slip within the clamping assembly. This is especially true when the piles are coated with barnacles or other materials that reduce friction between the gripping surfaces and the pile.

Slippage of the pile relative to the clamping assembly lessens the effectiveness of the clamping assembly at transmitting loads to the pile. Further, during insertion of the pile, such slippage can result in the pile moving upward relative to the clamping assembly housing and contacting an upper wall of this housing. Then, as further driving and/or vibratory forces are applied to the pile, the pile batters the upper wall of the housing. This can cause damage to the clamping assembly housing itself, to the assembly by which the housing is attached to the vibratory device or tensioning cable, and to the machined surfaces on the vibratory device.

Another problem with the prior art clamping assemblies is that bolts used to attach the housing thereof to a vibratory device must be installed from within the housing. This is an awkward and time consuming process and exposes the mounting bolts to the impact of the pile.

Yet another problem with prior art clamping assemblies is that, because different gripping surfaces are required for different types of piles, a different clamping assembly is required for each of the types of piles that will be driven or pulled. This is especially a problem in cases where wooden piles are being removed and replaced with more permanent piles such as concrete or steel. In this situation, the entire clamping assembly must be removed from the vibratory device between the removal of one pile and the insertion of another.

From the following discussion, it will be apparent that these and other problems with prior art clamping assemblies are solved by the present invention.

OBJECT OF THE INVENTION

From the foregoing, it should be clear that one primary object of the present invention is to provide an improved clamp assembly for securely attaching a pile to a vibratory device or the like.

A further object of the invention is to provide a clamp assembly having a favorable combination of the following characteristics:

(a) reduction in slippage of the pile relative to the clamp assembly;

(b) improved pile driving ability;

(c) reduction of damage to clamp assembly, connecting assembly, and vibratory device should slippage of the pile relative to the clamp assembly occur;

(d) easier attachment of the clamp assembly to the vibratory device;

(e) ability to quickly and easily change from gripping one pile type to gripping another pile type; and (f) allows the operator of the pile driving and/or pulling equipment to view the operation of the gripping assembly and the activities of workers on the other side of the pile.

As will become clear from the following detailed discussion, these and other objects are achieved by the present invention.

SUMMARY OF THE INVENTION

The present invention is a clamp for attaching piles to vibratory devices and the like basically comprising: (a) housing; (b) first gripping surface securely attached to the housing; (c) pivot arm rotatably attached to the housing; (d) second gripping surface rotatably attached to the pivot arm; and (e) piston actuator arranged to move the pivot arm and thus the second gripping surface towards the first gripping surface. By pivotably attaching the second gripping surface to the pivot arm, the second gripping surface can articulate as the pivot arm is moved to grip the pile such that the second gripping surface is always oriented in a desired position relative to the pile. In particular, the second gripping surface is an essentially flat plate with a textured engaging surface that is altered depending on the configuration of the pile being pulled. The engaging surface operates most effectively when it is parallel to the axis of the pile being driven. The articulating action of the second gripping member allows the second gripping member to self-adjust as it engages the pile during clamping such that the engaging surface is parallel to the axis of the pile. The articulating gripping member is thus always arranged in the optimal orientation for applying loads to the pile.

In another form, the present invention is a clamping device for attaching piles to a vibratory device comprising: (a) housing; (b) first clamping member securely attached to the housing; (c) pivot arm rotatably attached to the housing; (d) second gripping member attached to the pivot arm; (e) piston actuator for moving the pivot arm and thus the second gripping member towards the first gripping member; and (f) anvil means formed on an upper surface of the housing for applying driving loads to the pile when the pile engages an upper wall of the housing. Accordingly, should the pile slip relative to the housing and contact an upper wall thereof, the anvil means will contact the pile to apply driving forces thereto. The anvil means are arranged to reinforce the upper wall of the housing to prevent damage thereto. Additionally, impact absorbing materials may be attached to the anvil means to absorb the impact of the pile on the anvil means.

Further, the anvil means itself comprises an upper wall vertically spaced from the upper wall of the housing. The anvil upper wall is adapted to be connected to the vibratory device. Accordingly, even if damage should occur to the clamp housing upper wall, the clamp housing upper wall is spaced from the anvil upper wall such that the anvil upper wall will remain undamaged. This prevents damage to the bolts attaching the anvil to the vibratory device and to the machine surfaces of the vibratory device. Preferably, but not essentially, the anvil means is employed in combination with the articulating gripping member described above.

DETAILED DESCRIPTION

Figure 1:
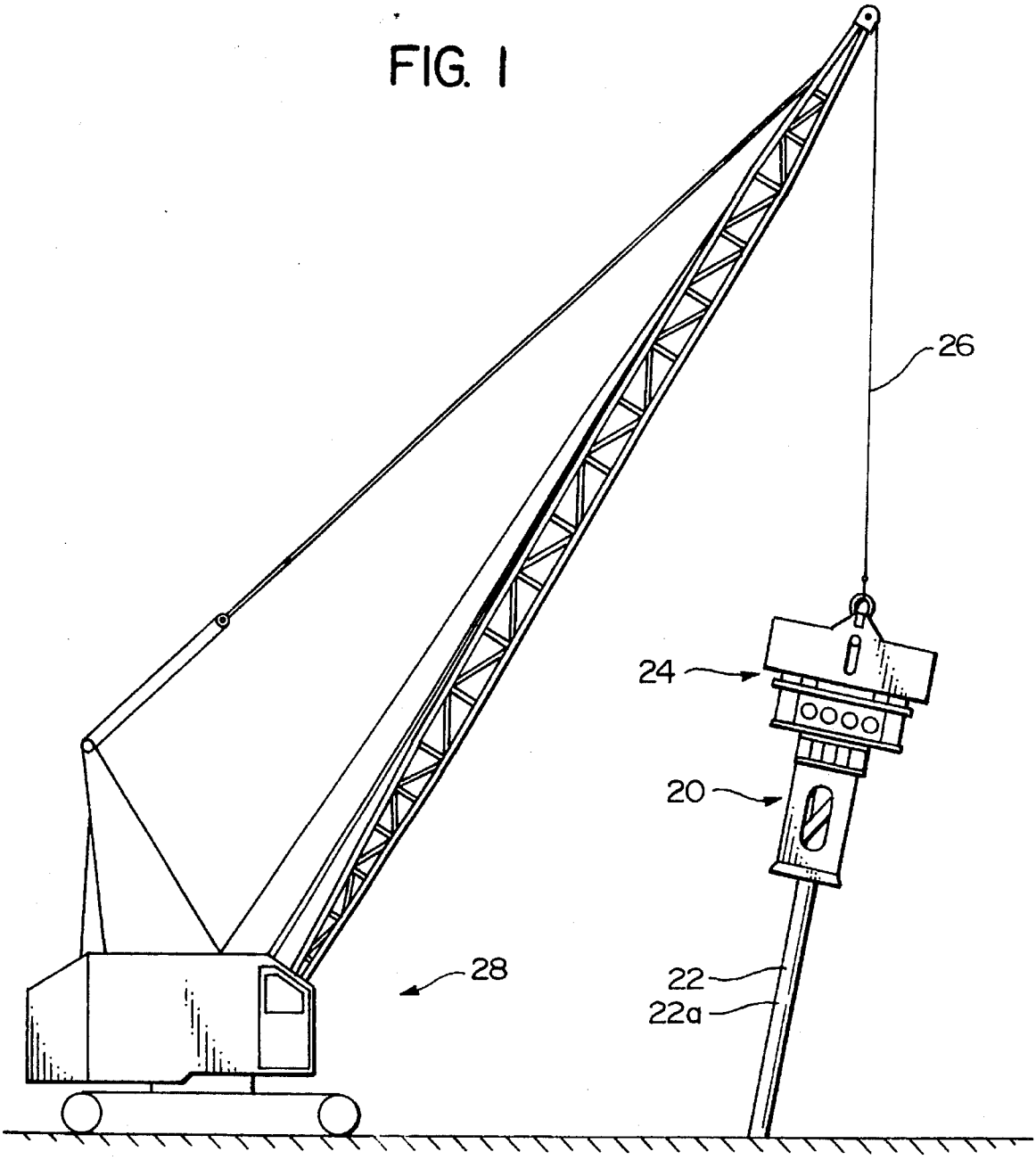
FIG. 1 depicts a pile driving and/or pulling apparatus driving a pile using a clamp assembly of the present invention.

Referring initially to FIG. 1, depicted therein at 20 is a clamp assembly constructed in accordance with, and embodying, the principles of the present invention. In FIG. 1, the clamp assembly 20 is shown attaching a pile 22 to a vibratory device 24 suspended by a tensioning cable 26 from a crane 28. The vibratory device 24 can be, for example, the APE Model 200 Vibro available from American Piledriving Equipment. The vibratory device 24, tensioning cable 26, and crane 28 are not in themselves part of the present invention, are well-known in the industry, and thus will be described herein only to the extent necessary for a complete understanding of the present invention.

Figure 2:
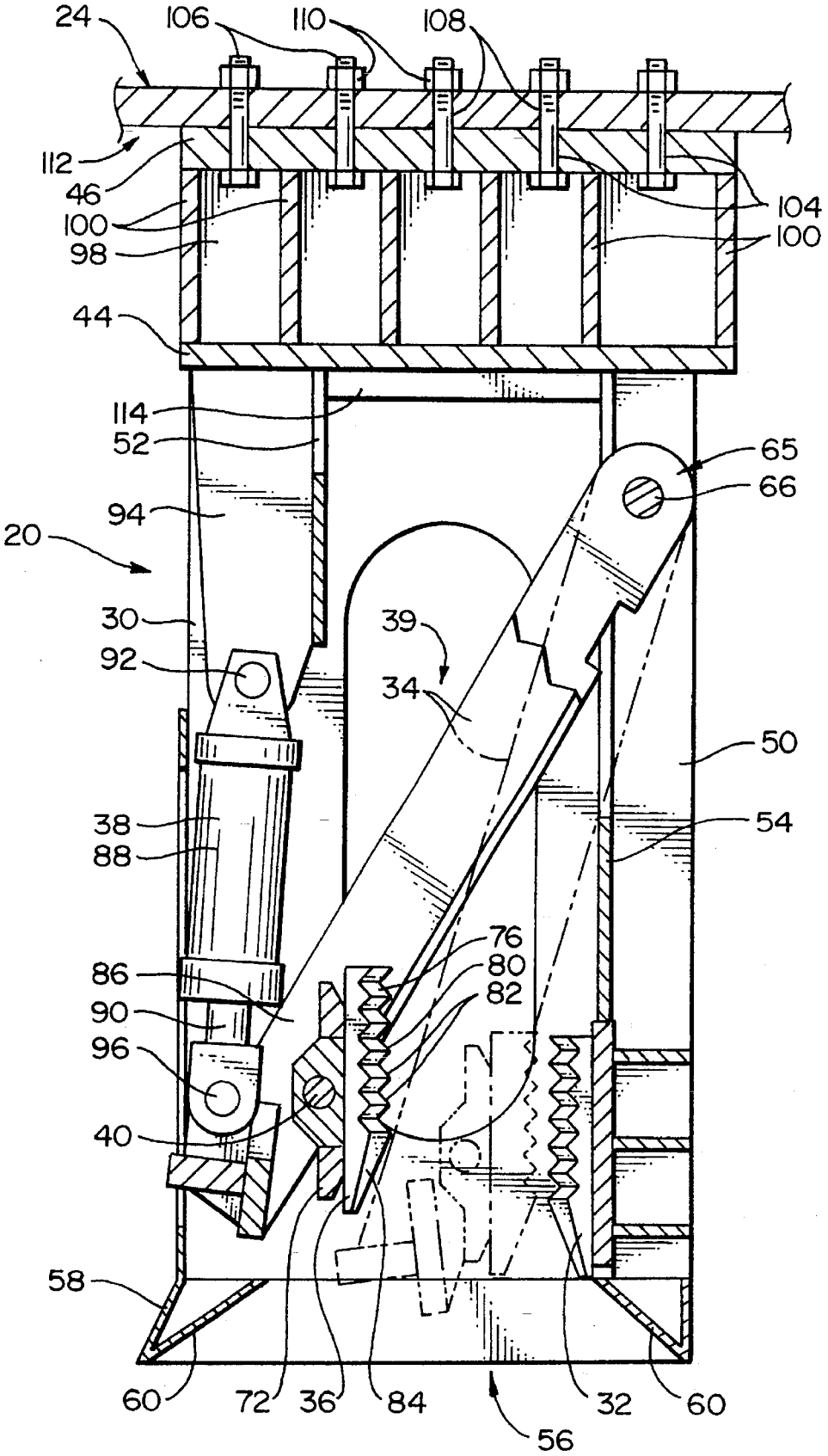
FIG. 2 depicts a front partial cut-away view of the clamp assembly of the present invention.

As perhaps best shown in FIG. 2, the exemplary clamp assembly 20 basically comprises: (a) a housing 30; (b) a fixed gripping assembly 32 rigidly attached to the housing 30; (c) a pivot member 34 pivotably attached to the housing 30; (d) a movable gripping assembly 36 rotatably attached to the pivot member 34; and (e) a piston actuator 38 arranged to displace the pivot member 34 between an open position shown by solid lines and a closed position shown by broken lines.

Figure 3:
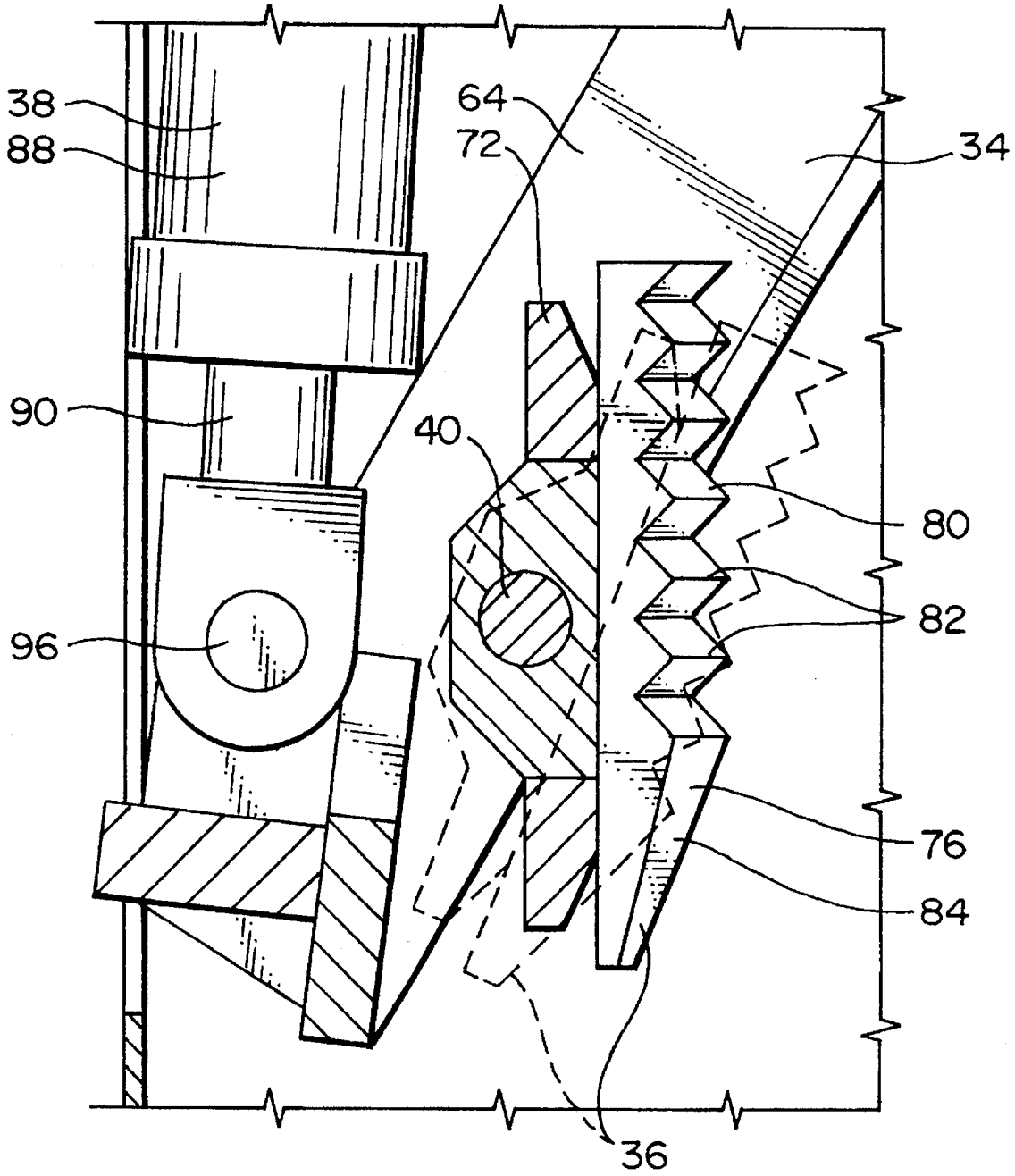
FIG. 3 shows a partial cut-away view of the clamp assembly shown in FIG. 2 depicting the movable gripping member thereof.

As shown somewhat in FIG. 2 and in detail in FIG. 3, the movable gripping assembly 36 is attached to the pivot member 34 by a grip member pin 40 such than the movable gripping assembly 36 can rotate relative to the pivot member 34. Accordingly, the movable gripping assembly 36 can rotate, for example, through positions depicted by solid and broken lines in FIG. 3.

When the movable gripping assembly 36 engages the pile 22 in a desired orientation relative to the pile 22, the clamp assembly 20 more effectively transmits driving, pulling, and vibratory forces to the pile 22. The ability of the movable gripping assembly 36 to rotate allows the second gripping assembly 36 to self-adjust as it engages the pile 22 into its desired orientation. The rotation of the second gripping assembly 36 thus ensures that the ability of the clamp assembly 20 to transmit forces to the pile 22 is optimized.

The fixed gripping assembly 32, the pivot member 34, the movable gripping assembly 36, and the piston actuator 38 together comprise a gripping means 39 for gripping the pile 22.

Referring again to FIG. 2 of the drawing, generally depicted at 42 therein is an anvil portion of the clamp assembly 20. The anvil portion 42 extends upwardly from and is rigidly connected to an upper wall 44 of the housing 30. The anvil portion 42 performs two basic functions. First, it reinforces the housing upper wall 44 so that, should the pile 22 slip and contact the housing upper wall 44, damage to the housing upper wall 44 will be prevented or at least minimized.

Second, the anvil portion 42 contains an anvil plate 46 that is attached to the vibratory device 24. The anvil plate 46 is spaced a distance above the housing upper wall 44; even if the housing upper wall 44 becomes damaged because of contact with the pile 22, the anvil plate 46 will remain undamaged, and the integrity of the attachment between the clamp assembly 20 and the vibratory device 24 will be maintained.

Turning now again to FIGS. 2, 3, and 4, the details of operation and construction of the clamp assembly 20 will be discussed. The housing 30 basically comprises the upper wall 44, a front wall 48, a back wall 50, a left side wall 52, and a right side wall 54. A passageway 56 allows the pile 22 to be inserted into the interior of the housing 30. A flange 58 having slanted inner walls 60 extends around the passageway 56 and directs the pile 22 along the passageway 56.

The pivot member 34 is generally u-shaped and rigid and comprises first and second pivot arms 62 and 64. A pivot pin 66 extends through an upper portion 65 of the pivot arms 62 and 64 between the front wall 48 and the back wall 50. The pivot member 34 thus pivots about an axis defined by the pivot pin 66. The range through which the pivot member 34 pivots is defined by the location of the left side wall 52 and the right side wall 54. The pivot arms 62 and 64 extend through slots 68 and 70 in, and thus straddle, the right side wall 54.

Aside from the fact that one is fixed and one is movable, the fixed and movable gripping assemblies 32 and 36 are essentially the same and only the movable gripping assembly 36 will be described in detail herein, with the understanding that the following discussion also applies to the fixed gripping assembly 32 as well.

The movable gripping assembly 36 comprises a backing plate 72 and first and second gripping members 74 and 76 rigidly connected to the backing plate 72. As is well-known in the art, each of these gripping members 74 and 76 comprises a textured surface 78 and 80 to enhance the ability of the gripping means 39 to grip the pile 22. The exemplary surfaces 78 and 80 shown have teeth 82 arranged orthogonal to the direction in which forces are applied to the pile and are designed to engage a wood pile. The textured surfaces 78 and 80 are canted with respect to each other to conform to a surface 22*a* of the cylindrical pile 22.

For any type of pile, the desired orientation of the gripping assemblies 32 and 36 relative to the pile is when the textured surfaces 78 and 80 are arranged substantially parallel to the surface 22*a* of the pile 22. The greater the area that engages the pile 22, the less likely the gripping means 39 will slip as the pile 22 is being driven. With the exemplary textured surfaces 78 and 80 shown, the teeth 82 are arranged orthogonal to the longitudinal axis of the pile 22 when the gripping assemblies 32 and 36 are in the desired orientation relative to the pile 22.

The gripping members 74 and 76 each further comprise a slanted lower surface 84 that channels the pile 22 along the passageway 56.

As mentioned above, the movable gripping assembly 36 is attached to the pivot member 34 by the grip member pin 40. More specifically, the grip member pin 40 extends between a lower portion 86 of the pivot member arms 62 and 64 and through the backing plate 72. The backing plate 72, and thus the gripping members 74 and 76, can rotate about the longitudinal axis of the grip member pin as shown by the solid and broken lines in FIG. 3. This allows the gripping assembly 36 to move or rotate as described above such that the movable gripping assembly 36 can swing into its desired orientation with respect to the pile 22.

Thus, as the piston actuator 38 forces the moveable gripping assembly 36 towards the fixed gripping assembly 32 to grip the pile 22, the moveable gripping assembly 36 will rotate until the textured surfaces 78 and 80 thereof are substantially parallel with a surface 22*a* of the pile 22.

Referring now to the piston actuator 38, this piston actuator 38 comprises a cylinder 88 and a rod 90. As is generally known in the art, injection of hydraulic fluid through appropriates ports in the cylinder 88 causes the rod 90 to extend from and retract into the cylinder 88. The cylinder 88 is attached by a cylinder pin 92 to a flange 94 rigidly extending from the left side wall 52, while the rod 90 is attached by a rod pin 96 to the lower portion 86 of the pivot member arms 62 and 64. Thus, when the rod 90 extends and retracts from the cylinder 88, the pivot member 34 rotates in an arc about the pivot pin 66 as shown by broken and solid lines in FIG. 2. This causes the gripping means 39 to grip the pile 22 and fix the pile 22 relative to the housing 30.

The basic operation of the piston actuator 38 is well-known in the art and many standard pistons may be employed to perform this operation; however, the exemplary piston actuator 38 is optimized for use in the clamp assembly 20. In particular, the cylinder 88 is constructed from one piece and does not employ tie rod bolts and washers as found on other cylinders. The rod 90 is greatly oversized to prevent bending during the gripping of unusually shaped piles. The exemplary rod 90 is 4.5 inches in diameter and is preferably greater than 3.5 inches in diameter. The seals used in the cylinder 88 are bronze impregnated to improve life and reduce leakage.

Figure 4:
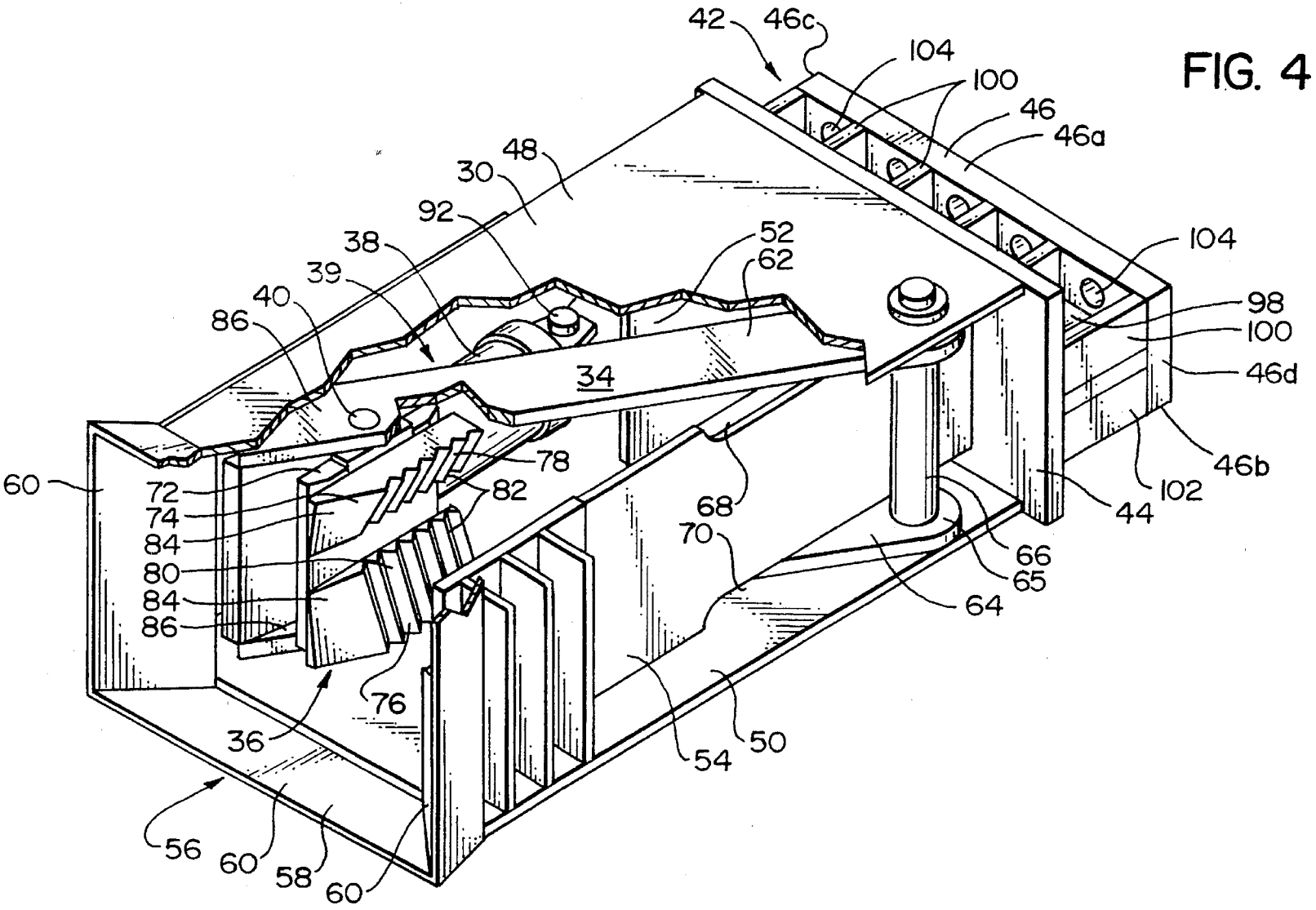
FIG. 4 depicts a partial cut-away perspective view showing details of construction of the clamp assembly of the present invention.

Referring now to FIGS. 2 and 4, the construction and operation of the anvil portion 42 will be described in further detail.

The anvil portion 42 basically comprises the upper wall 44 of the housing 30, the anvil plate 46, a lateral plate 98, and a plurality of front plates 100, and a plurality of rear plates 102. The anvil plate 46 has a front edge 46*a*, a back edge 46*b*, a left side edge 46*c*, and a right side edge 46*d*.

The lateral plate 98 extends between the left side edge 46*c* and the right side edge 46*d* midway between the front edge 46*a* and the back edge 46*b*. The lateral plate 98 is rigidly connected to the upper wall 44 and the anvil plate 46 by welding or the like.

The front plates 100 are equally spaced from each other between the lateral plate 98 and the anvil plate front edge 46*a*, while the rear plates 102 are also equally spaced from each other and extend between the lateral plate 98 and the anvil plate rear edge 46*b*. The front plates 100 and the rear plates 102 are rigidly connected to the upper wall 44, the anvil plate 46, and the lateral plate 98 by welding or the like.

Front attachment holes 104 and rear attachment holes (not shown) corresponding to the front attachment holes 104 are formed in the anvil plate 46. The front attachment holes 104 are formed between the lateral plate 98 and the anvil plate front edge 46*a*, while the rear attachment holes are formed between the lateral plate 98 and the anvil plate rear edge 46*b*.

The clamp assembly 20 is fastened to the vibratory device 24 by attachment bolts 106 than are inserted through the front and rear attachment holes in the anvil plate and corresponding holes 108 formed in the vibratory device 24. Nuts 110 are employed to secure the bolts 106 within the holes 104. The front and rear attachment holes 104, attachment bolts 106, holes 108 in the vibratory device 24, and nuts 110 form an attachment means 112 for attaching the clamp assembly 20 to the vibratory device 24.

As perhaps best shown by the perspective view in FIG. 4, the front and rear attachment holes in the anvil plate 46 are easily accessible; this easy accessibility greatly facilitates the insertion and tightening of the bolts employed to attach the clamp assembly 20 to the vibratory device 24. Consequently, the attachment of the clamp assembly 20 to and removal of the clamp assembly 20 from the vibratory device 24 can be performed more simply and quickly.

Assembled as just-described, the lateral plate 98, front plates 100, and rear plates 102 reinforce the upper wall 44 of the housing 30; accordingly, should the pile 22 slip as it is being driven and contact the upper wall 44, the plates 98, 100, and 102 that reinforce this wall 44 will alleviate damage to the wall 44.

Additionally, the lateral plate 98, front plates 100, and rear plates 102 space the anvil plate 46 a distance above the housing upper wall 44. Should the pile 22 damage the housing upper wall 44, the spacing of the anvil plate 46 above the upper wall 44 will help prevent damage to the upper wall 44 from being transmitted to the anvil plate 46. Therefore, because the attachment bolts 106 connecting the clamp assembly 20 to the vibratory device 48 extend through the anvil plate 46, the spacing of the anvil plate 46 above the upper wall 44 will help prevent the damage to the attachment bolts 106. This helps maintain the integrity of the attachment means 112 for attaching the clamp assembly 20 to the vibratory device 24 should the pile 22 slip within the clamping means 39.

Further, as shown in FIG. 2, a shock absorbing material 114 may be placed on the anvil upper wall 44. Should the pile 22 slip, the pile 22 will contact the shock absorbing material 114 and will not directly contact the anvil upper wall 44. The shock absorbing material 114 thus additionally protects the vibratory device 24 and anvil upper wall 44.

The clamp assembly 20 as just described alleviates slippage of the pile 22; reduces damage should such slippage occur; increases the rate at which piles can be driven and extracted by simplifying the process of switching gripping members designed for different pile types; simplifies the process of attaching the clamp assembly 20 to the vibratory device 24; and reduces cost to the end user because substantial portions of the clamp assembly 20 can be used for different types of piles.

From the foregoing, it should be clear to one of ordinary skill in the art that the present invention may be embodied in forms other than those described above in detail. The above described embodiment is therefore to be considered in all respects illustrative and not restrictive, the scope of the invention being indicated by the appended claims rather than the foregoing description. All changes that come within the meaning and scope of the claims are intended to be embraced therein.

What is claimed is:

1. A clamp assembly for attaching a pile to a pile driving apparatus for inserting and/or extracting the pile, comprising:

a. a housing;

b. a first gripping assembly rigidly attached to the housing;

c. a pivot member pivotably attached to the housing by a pivot pin;

d. a second gripping assembly rotatably attached to the pivot member; and e. actuating means for displacing the pivot member and the second gripping assembly such that the pile is gripped between the first and second gripping assemblies, the actuating means comprising a piston actuator having a first end rotatably connected to the housing and a second end rotatably attached to the pivot member by an actuator pin; wherein f. as the second gripping assembly engages the pile, the second gripping assembly moves relative to the pivot member into a desired orientation relative to the pile; and g. the pivot pin and the actuator pin are removed to allow removal and replacement of the second gripping assembly.

2. A clamp assembly as recited in claim 1, in which the second gripping assembly is attached to the pivot member by a grip member pin, where the second gripping assembly rotates about the grip member pin.

3. A clamp assembly as recited in claim 2, in which the pivot member comprises first and second arm portions, the grip member pin extends between the first and second arm portions, and the second gripping assembly is arranged between the first and second arm portions.

4. A clamp assembly as recited in claim 1, in which the housing comprises a housing upper wall, further comprising:

a. an anvil plate; and b. a plurality of vertical plates extending between the housing upper wall and the anvil plate.

5. A clamp assembly as recited in claim 4, in which the anvil plate is adapted to be connected to the pile driving apparatus.

6. A clamp assembly as recited in claim 5, in which the plurality of vertical plates are arranged to allow access to at least an exposed portion of a lower surface of the anvil plate.

7. A clamp assembly as recited in claim 6, in which:

a. mounting holes are formed in the exposed portion of the lower surface of the anvil plate; and b. bolts are inserted into the mounting holes to fasten the clamp assembly to the pile driving apparatus.

8. A clamp assembly for attaching a pile to a pile driving apparatus for inserting and/or extracting the pile, comprising:

a. a housing comprising a housing upper wall;

b. gripping means located within the housing for gripping the pile; and c. anvil means for engaging the pile should the gripping means fail to grip the pile, the anvil means comprising an anvil plate spaced above the housing upper wall and a plurality of vertical plates rigidly connected between the anvil plate and the housing upper wall.

9. A clamp assembly as recited in claim 8, in which means are formed in the anvil plate for allowing the anvil plate to be connected to the pile driving apparatus.

10. A clamp assembly as recited in claim 9, in which the plurality of vertical plates are arranged to allow access to at least an exposed portion of a lower surface of the anvil plate.

11. A clamp assembly as recited in claim 10, in which:

a. mounting holes are formed in the exposed portion of the lower surface of the anvil plate; and b. bolts are inserted into the mounting holes to fasten the clamp assembly to the pile driving apparatus.

12. A clamp assembly as recited in claim 8, in which at least one opening is formed in the housing to allow at least a portion of the gripping means to be seen by an operator of the pile driving apparatus.

13. A clamp assembly for attaching a pile to a pile driving apparatus for inserting and/or extracting the pile, comprising:

a. a generally rectangular housing having an upper wall, a front side wall, a back side wall, a first side wall, and a second side wall;

b. a fixed gripping assembly rigidly attached to an inner surface on the second side wall;

c. a pivot member having a first end pivotably connected to the housing by a pivot pin, where the pivot pin extends between the front and back side walls;

d. a movable gripping assembly rotatably connected to a second end of the pivot member by a grip member pin; and e. a piston actuator having:

i. a cylinder rotatably attached by a cylinder pin to an inner surface of the first side wall, and ii. a rod rotatably attached to the second end of the pivot member by a rod pin; wherein f. the pile is inserted from below into the housing between the fixed and movable gripping assemblies;

g. actuation of the piston actuator to extend the rod causes the movable gripping assembly to rotate downwards relative to the housing about an axis defined by the pivot pin towards the fixed gripping assembly to grip the pile therebetween; and h. upon contacting the pile, the second gripping assembly rotates relative to the pivot member about an axis defined by the grip member pin into a desired orientation with respect to the pile.

14. A clamp assembly as recited in claim 13, further comprising:

a. a generally rectangular anvil plate having front, back, left, and right edges; and b. a lateral support plate rigidly connected to the anvil plate and to the housing upper wall.

15. A clamp assembly as recited in claim 13, in which:

a. the anvil plate is generally rectangular and has front, back, left, and right edges; and b. the lateral support plate extends from the left edge to the right edge of the anvil plate and is substantially equidistant from the front and back edges of the anvil plate; wherein c. the clamp assembly further comprises a plurality of front and back support plates rigidly connected to the anvil plate, the lateral support plate, and the housing upper wall.

16. The clamp assembly as recited in claim 15, in which:

a. the front support plates extend between the lateral support plate and the front edge of the anvil plate;

b. the back support plates extend between the lateral support plate and the back edge of the anvil plate; and c. mounting holes are formed in the anvil plate between the front and back support plates, where bolts are inserted into the mounting holes to attach the clamp assembly onto the pile driving apparatus.

17. A clamp assembly for attaching a pile to a pile driving apparatus for inserting and/or extracting the pile, comprising:

a. a housing comprising a housing upper wall;

b. a first gripping assembly rigidly attached to the housing;

c. a pivot member pivotably attached to the housing;

d. a second gripping assembly rotatably attached to the pivot member;

e. actuating means for displacing the pivot member and the second gripping assembly such that the pile is gripped between the first and second gripping assemblies;

f. an anvil plate; and g. a plurality of vertical plates extending between the housing upper wall and the anvil plate; wherein h. as the second gripping assembly engages the pile, the second gripping assembly moves relative to the pivot member into a desired orientation relative to the pile.

18. A clamp assembly as recited in claim 17, in which means are formed in the anvil plate for allowing the anvil plate to be connected to the pile driving apparatus.

19. A clamp assembly as recited in claim 18, in which the plurality of vertical plates are arranged to allow access to at least an exposed portion of a lower surface of the anvil plate.

20. A clamp assembly as recited in claim 19, in which:

a. mounting holes are formed in the exposed portion of the lower surface of the anvil plate; and b. bolts are inserted into the mounting holes to fasten the clamp assembly to the pile driving apparatus.

* * * * *

US005609380B1

REEXAMINATION CERTIFICATE (4153rd)

United States Patent [19] [11] B1 5,609,380

White [45] Certificate Issued Sep. 12, 2000

[54] CLAMP ASSEMBLIES FOR DRIVING PILES INTO THE EARTH

[75] Inventor: John L. White, Kent, Wash.

[73] Assignee: American Piledriving Equipment, Inc., Kent, Wash.

Reexamination Request:
No. 90/005,256, Feb. 10, 1999

Reexamination Certificate for:

| | |
|---|---|
| Patent No.: | **5,609,380** |
| Issued: | **Mar. 11, 1997** |
| Appl. No.: | **08/340,052** |
| Filed: | **Nov. 15, 1994** |

[51] Int. Cl.[7] ..... B66C 1/44; E02D 7/18

[52] U.S. Cl. ..... 294/104; 294/88; 405/232

[58] Field of Search ..... 294/86.23, 86.29, 294/86.4, 88, 103.1, 104, 106, 113; 173/49, 90, 91, 124, 128, 130–132, 162.1, 210; 405/228, 232, 245–247, 231

[56] References Cited

U.S. PATENT DOCUMENTS 3,998,063 12/1976 Harders ..... 294/103.1 X

OTHER PUBLICATIONS

ICE brochure, Model 50 and Model 126, International Construction Equipment, Inc.

International Construction Equipment, Inc., Model 75 pile clamp assembly.

*Primary Examiner*—Johnny D. Cherry

[57] ABSTRACT

A clamp assembly for attaching a pile to a device for inserting and/or extracting the pile. The clamp assembly has a fixed gripping assembly and a movable gripping assembly. The fixed gripping assembly is rigidly attached to a housing. The movable gripping assembly is rotatably attached to a pivot arm that is pivotably attached to the housing. The pile is placed between the gripping assemblies and a piston causes the pivot arm to rotate such that the pile is gripped between the gripping assemblies. The movable gripping assembly rotates relative to the pivot arm into a desirable position relative to the pile as it engages the pile to increase the ability of the clamp assembly to grip the pile. An anvil formed on the top of the clamp assembly facilitates attachment of the clamp assembly to the pile driving and/or extracting device and alleviated damage to the bolts used to attach the clamp assembly to the pile driving and/or extracting device.

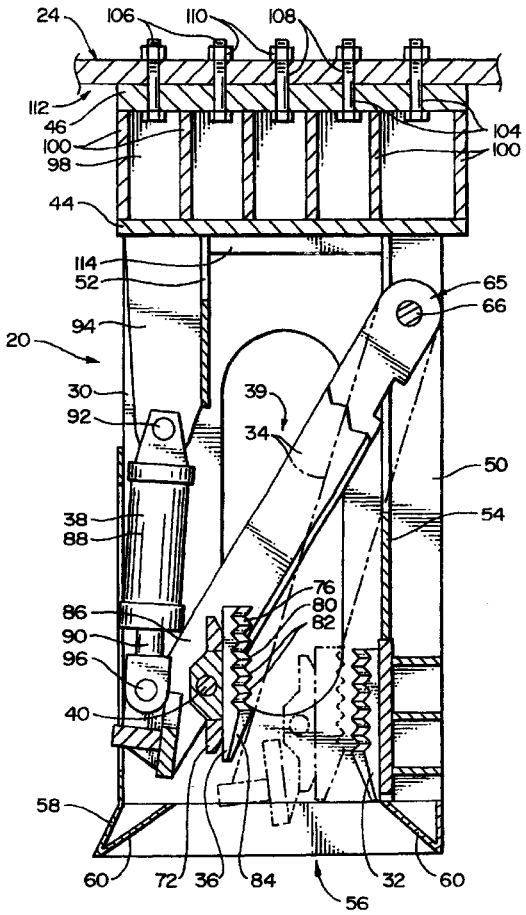

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 9–12, 14 and 16 are cancelled.

Claims 1, 3, 8, 13 and 17 are determined to be patentable as amended.

Claims 2, 4–7, 15 and 18–20, dependent on an amended claim, are determined to be patentable.

1. A clamp assembly for attaching a pile to a pile driving apparatus for inserting and/or extracting the pile, comprising:

a. a housing *comprising a front wall, a back wall, a left side wall, and a right side wall defining a household passageway*;

b. a first gripping assembly rigidly attached to the *right side wall of the* housing;

c. a pivot member pivotably attached to the housing by a pivot pin*, where the pivot pin extends between the front and back walls outside of the housing passageway, part of the pivot member is located within the housing passageway, and the pivot member comprises at least one arm portion that extends through an opening in the right side wall*;

d. a second gripping assembly rotatably attached to the pivot member *such that at least a portion of the second gripping assembly is within the housing passageway*; and e. actuating means for displacing the pivot member and the second gripping assembly such that the pile is gripped between the first and second gripping assemblies, the actuating means comprising a piston actuator having a first end rotatably connected to the housing and a second end rotatably attached to the pivot member by an actuator pin; wherein f. as the second gripping assembly engages the pile, the second gripping assembly moves relative to the pivot member into a desired orientation relative to the pile; [and]

g. the pivot pin and the actuator pin are removed to allow removal and replacement of the second gripping assembly.

3. A clamp assembly as recited in claim 2, in which the pivot member comprises first and second arm portions, the grip member pin extends between the first and second arm portions, [and] the second gripping assembly is arranged between the first and second arm portions*, and the first and second arm portions are arranged on either side of the pile when the pile is gripped by the first and second gripping assemblies*.

8. A clamp assembly for attaching a pile to a pile driving apparatus for inserting and/or extracting the pile, comprising:

a. a housing comprising a housing upper wall;

b. gripping means located within the housing for gripping the pile; [and]

c. anvil means for engaging the pile should the gripping means fail to grip the pile, the anvil means comprising an anvil plate spaced above the housing upper wall*, a lateral plate connected between the anvil plate and the housing upper wall, a plurality of front plates rigidly connected to the anvil plate, the housing upper wall, and the lateral plate,* and a plurality of [vertical] *back* plates rigidly connected between the anvil plate [and], the housing upper wall*, and the lateral plate; and*

*a plurality of bolts for connecting the housing to the pile driving apparatus, where the bolts extend through the anvil plate at locations spaced on either side of the lateral plate and between the front and back plates; wherein*

*the lateral plate, front plates, and back plates space the anvil plate from the housing upper wall to inhibit damage to the bolts if the housing upper wall is damaged.*

13. A clamp assembly for attaching a pile to a pile driving apparatus for inserting and/or extracting the pile, comprising:

a. a generally rectangular housing having an upper wall, a front side wall, a back side wall, a first side wall, and a second side wall *defining a housing opening and a housing passageway into which the pile is inserted when the pile is attached to the pile driving apparatus*;

b. a fixed gripping assembly rigidly attached to an inner surface on the second side wall *at a first vertical location*;

c. a pivot member having a first end pivotably connected [to the housing] *between the front and back side walls* by a pivot pin, wherein the pivot pin extends between the front and back side walls *at a second vertical location that is spaced above the first vertical location, the pivot member further comprising a second end arranged outside of the housing passageway*;

d. a movable gripping assembly rotatably connected to a second end of the pivot member by a grip member pin *such that the movable gripping assembly is spaced on an opposite side of the housing passageway from the second side wall*; and e. a piston actuator *located outside of the housing passageway and* having:

i. a cylinder rotatably attached by a cylinder pin to an inner surface of the first side wall, and ii. a rod rotatably attached to the second end of the pivot member by a rod pin; wherein f. the pile is inserted from below into the housing between the fixed and movable gripping assemblies;

g. actuation of the piston actuator to extend the rod causes the movable gripping assembly to rotate downwards relative to the housing about an axis defined by the pivot pin towards the fixed gripping assembly to grip the pile therebetween; and h. upon contacting the pile, the second gripping assembly rotates relative to the pivot member about an axis defined by the grip member pin into a desired orientation with respect to the pile.

17. A clamp assembly for attaching a pile to a pile driving apparatus for inserting and/or extracting the pile, comprising:

a. a housing comprising a housing upper wall;

b. a first gripping assembly rigidly attached to the housing *on a first side of the housing passageway*;

c. a pivot member *having a first end* pivotably attached to the housing *outside of the housing passageway on the first side of the housing passageway and a second end that extends outside of the housing passageway on a second side of the housing passageway, where the second side of the housing passageway is substantially opposite to the first side of the housing passageway*;

d. a second gripping assembly rotatably attached to the pivot member *within the housing passageway*;

e. actuating means *arranged outside of the housing passageway and connected to the second end of the pivot*

*member* for displacing the pivot member and the second gripping assembly such that the pile is gripped between the first and second gripping assemblies;

f. an anvil plate; and g. a plurality of vertical plates extending between the housing upper wall and the anvil plate; wherein h. as the second gripping assembly engages the pile, the second gripping assembly moves *towards the first gripping assembly to grip the pile and also rotates* relative to the pivot member into a desired orientation relative to the pile.

* * * * *